US005454282A

United States Patent [19]

Del Mistro

[11] Patent Number: 5,454,282

[45] Date of Patent: Oct. 3, 1995

[54] POCKET CORKSCREW

[75] Inventor: Licinio Del Mistro, Maniago, Italy

[73] Assignee: Effegi s.r.l., Pordenone, Italy

[21] Appl. No.: 13,354

[22] Filed: Feb. 4, 1993

[30] Foreign Application Priority Data

Mar. 23, 1992 [IT] Italy ..... PN92A0020

[51] Int. Cl.[6] ..... B61B 7/04

[52] U.S. Cl. ..... 81/3.48; 81/3.09; 81/3.36

[58] Field of Search ..... 81/3.09, 3.36, 81/3.37, 3.48

[56] References Cited

U.S. PATENT DOCUMENTS 786,492 4/1905 Garimaldi ..... 81/3.37

4,437,359 3/1984 DeJoux et al. ..... 81/3.09

4,584,911 4/1986 Cellini ..... 81/3.36

*Primary Examiner*—James G. Smith

*Attorney, Agent, or Firm*—Oblon, Spivak, McClelland, Maier & Neustadt

[57] ABSTRACT

In a pocket corkscrew, a handle 1 is pivotally operated around two fulcra (4, 6)—around the first one (4) during a first run of the cork (14) and around the second one (6) during the second and definitive run of the same cork. Increase of the arm 2-4 into the arm 2-6 allows the cork (14) to run a further path d2, avoiding a second screwing of the extracting means 3.

4 Claims, 4 Drawing Sheets

POCKET CORKSCREW

FIELD OF THE INVENTION

The present invention relates to a pocket corkscrew. The corkscrew comprises a handle, a screw connected to the handle in a substantially intermediate position of axial development of the handle, and a propping element connected at one end of the handle and provided with two pins. The handle can be pivoted around the two pins so as to increase, automatically and instantaneously, the arm of a second class lever formed by the handle, by the screw, and by the propping element, in order to make with just one operation a complete extraction of a cork from a bottle neck.

BACKGROUND OF THE INVENTION

It has been a long time since pocket corkscrew replaced professional use of traditional corkscrews, especially when they are used by operators in restaurants, hotels, communities, etc. Such pocket corkscrews were conceived as pocket knives (provided with blades and various tools) and were, therefore, handy and light, so that they can be inserted in a small pocket after using and after pivoting various tools to their rest positions. An additional advantage of pocket corkscrews is their obvious lower cost relative to traditional corkscrews.

A typical prior art pocket corkscrew comprises a cork extracting element in the form of a screw which is inserted in the cork and a propping element, which in use is leaned on the bottle neck. In their rest positions, the screw and the propping element are pivoted in such a way that they are received in the handle. When a bottle is to be uncorked, the propping element is pivoted externally, and the screw is pivoted in such a way that it can take up a substantially vertical position with respect to the handle. In that position, it is possible to screw the screw along the axis of the cork. At this point, the propping element is pivoted in such a way as to lean, with its external end, on the bottle neck. The handle, as a second class lever, is rotated around its fulcrum, which is placed on an end of the handle, with resistance substantially close to the point where force is applied. As soon as the corkscrew is activated, the handle is pivoted around the fulcrum of the propping element, which operates as a rotation fulcrum, whereby the screw is lifted and the cork is extracted from the bottle neck together with it.

The main drawback of a typical prior art pocket corkscrew lies in the fact that it is usually not possible to get a complete extraction of a cork with just one extraction operation. That is, it is usually necessary to repeat the screwing of the cork and the subsequent operation of leaning the propping element on the bottle neck, before completing the extraction operation. This is what typically happens with middle and large sizes of corks (up to 5 centimeters).

Indeed, some solutions have previously been conceived which allow a complete cork extraction from the bottle neck, avoiding a second cork screwing operation of the extraction element.

In a first known pocket corkscrew (European patent application—publication No. 0 041 026 of Feb. 2, 1981), the propping element is made of two elements (5, 6), the shorter one of which (5) is leaned on the bottle neck during a first phase of the extraction process, whereas the longer element (6) replaces the shorter element (5) in a second phase in order to complete the cork extraction process.

A second known pocket corkscrew is disclosed in U.S. Pat. No. 4,584,911, granted Apr. 9, 1989. It includes a slot provided with two notches 22, 23. A pin 13 is adapted to cooperate with one or the other of the two notches 22, 23, in either of which the pin 13 is the fulcrum of the propping element 21. The pin 13 can be manually adjusted inside the slot in order to increase the arm length between the pin 13 and the pin 15 of the extraction element 14 during the second phase of the cork extraction process. As previously stated, a manual adjustment operation is necessary in every case, which makes lost time to the operator. In addition, after extracting the cork, the pin 13 has to be replaced in its starting position.

The same U.S. patent describes a slot 26 inside which a pivot of the handle 11 runs from a first position 25 to a second position 17 of the pin 13, thanks to the action of the propping element 12 against a cam 18, which is formed on an end of the handle 11. The advantage of this solution mainly consists in the fact that the length of the arm between 25, 17 is gradually increased during passage from the first to the second phase of the cork extraction process. Beside production cost of pieces (in detail, it is necessary to provide a coating of slot 26 with a covering or metal protection clamp), the fulcrum 13 has to be returned back from 15 to 25 before arranging various tools (e.g., the extraction element and the propping element) in their rest positions, since otherwise the element 12 is not allowed to be positioned on the edge of a bottle neck for operating a further first phase of an extraction process. Therefore, the device disclosed in the U.S. patent requires both high production costs and a reloading operation before its further use.

Another pocket corkscrew was suggested in an Italian patent application, filed Jun. 1990 No. 83416-A/90, where, instead of the slot and cam of the previously mentioned device, the pin 2 around which the propping element rotates is pivotally and eccentrically mounted on a second pin 4, which is, in its turn, adapted to rotate in a seat obtained at an end of the handle 1. The propping element is adapted to acquire an initial position (so that it can cover the first extraction run). In correspondence of that position, the pin around which the propping element is pivotally mounted shapes a certain arm with a pin of the extraction element, while the pin around which the propping element is pivotally mounted acquires a position which causes the length of the arm to be substantially increased. This device can present a functional simplification of the previously described device. However, it gives rise to complications, due to the facts that:

a) if an activation of the corkscrew is required, it is necessary to open both the extraction element and the propping element in such a way that the position of the fulcrum 2' of the propping element, which is intermediate between the previously described first and second position, is reached;

b) after completing a first cork extraction, it is often necessary to manually make sure that the propping element is so positioned that a second cork extraction can be completed.

OBJECT OF THE INVENTION

A problem which the pocket corkscrew of this invention intends to solve is to automatically achieve a positioning between two fulcra of the extraction element and the propping element which represents the ideal solution for production cost and simple handling.

SUMMARY OF THE INVENTION

The foregoing problem is solved by a pocket corkscrew according to the invention, which is characterized by automatic and instantaneous variation means (4, 6, 8, 9, and 11) from an (c1) to an arm (c2). The arms (c1 and c2) are adapted to represent the distance between a pin of the extraction element (3) and the fulcrum of the handle (1).

BRIEF DESCRIPTION OF THE DRAWINGS

The foregoing characteristics and further ones will be apparent from the following description and from the attached drawings, wherein.

DETAILED DESCRIPTION OF THE PRESENTLY PREFERRED EMBODIMENT

Figure 2:
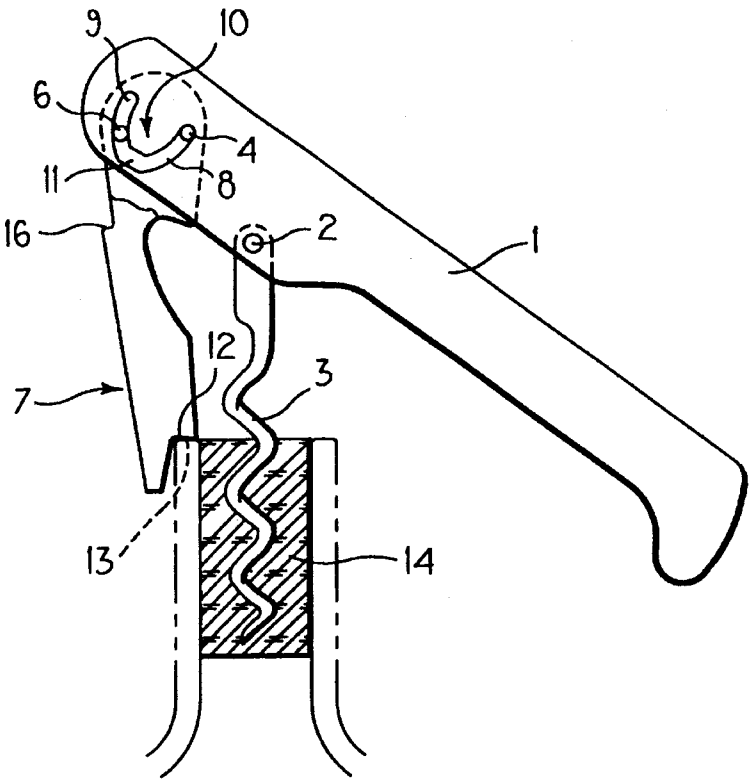
FIG. 2 is a front view of the corkscrew of Fig. 1 in an initial operating position.
Figure 1:
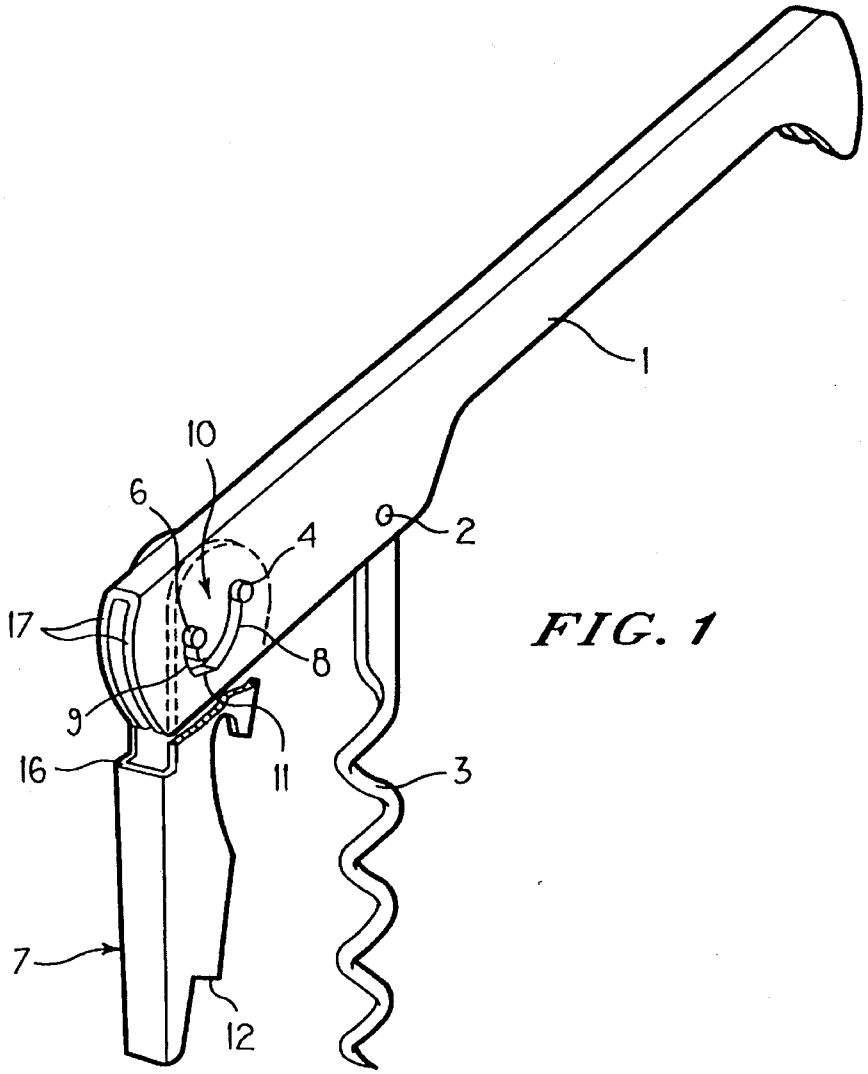
Fig. 1 is a perspective view of a corkscrew according to the invention.

The embodiment of a pocket corkscrew according to the invention comprises a handle 1, which represents a second class lever, as it will be explained later (FIG. 1). The handle 1 is made of a cut and folded metal sheet, so that it can make up, internally, two parallel faces which define a room into which a screw element 3 is placed. The screw element 3 is pivotally mounted on a pin 2 and represents the extraction element of the corkscrew.

At one end of the handle 1, a lever 7 is attached by means of two pins 4, 6. The lever 7 represents the propping element of the corkscrew according to the invention. The pins 4, 6 are second class levers and are defined as, respectively, a right and a left pin. The lever 7 is made of a cut and folded metal sheet, too, and it is dimensioned so as to be arranged inside the room which is defined by the two faces of the handle 1. The pins 4, 6 are, as it will be described hereafter, two fulcra around which the handle 1 is adapted to rotate during corkscrew operation.

The pins 4, 6 are mounted on two faces of the lever 7—i.e., on both the front face (which can be seen in the drawings) and the rear face (which can't be seen in the drawings) in such a way that they can slide in both the front and rear faces, respectively, within the two legs 8, 9 of a U-shaped slot 10.

The legs 8, 9 are joined by a bridge 11. The outline of each of the legs 8, 9 represents a circular sector the center of which is, respectively, formed by the pin 6 and by the pin 4.

Figure 6:
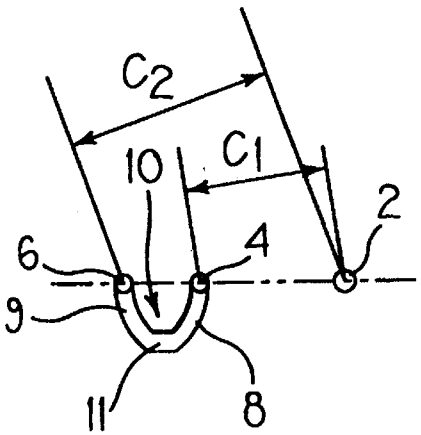

The two pins 4, 6, together with the legs 8, 9 and the bridge 11 represent, as it will be explained hereafter, automatic and instantaneous variation means of an arm c1 between the pin 2 and the pin 4. The arm c1 becomes the arm c2 between the pin 2 and the pin 5 (FIGS. 5, 6, and 7) during corkscrew operation. The handle 1 rotates, indeed, during a first working phase, around the pin 4 and then around the pin 6.

The lever 7 (FIGS. 1, 2, 3, and 4) is provided, at its lower part, with a shoulder 12 which, in use, cooperates with an edge 13 of a bottle neck, in order to obtain the result of a cork 14 extracted from the bottle neck. The shoulder 12 is formed both on the front and the rear face of the lever 7 in such a way that both faces can lean on the edge of the bottle neck.

The lever 7 is provided, at its upper end, with a shoulder 16. The path of the shoulder 16 is always, during operation work of the corkscrew, out from the path of the profile 17 of the left end of the handle 1, as represented in the drawings.

USE OF THE POCKET CORKSCREW

Figure 4:
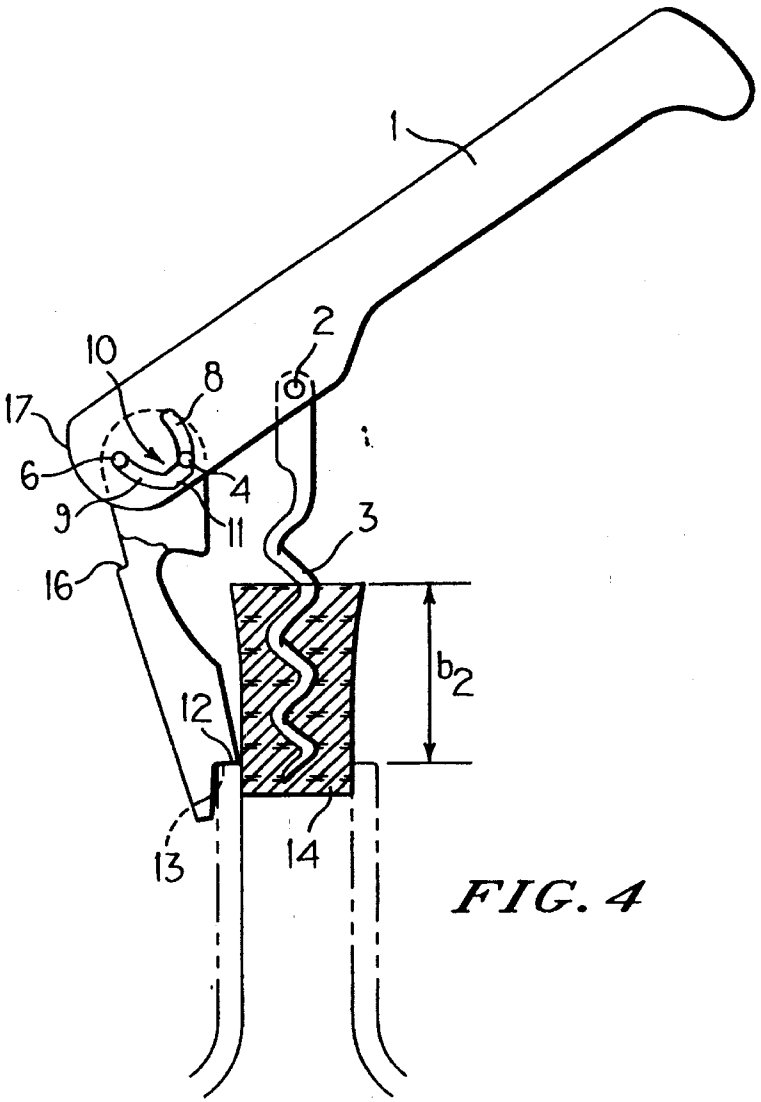
FIG. 4 is a front view of the corkscrew of FIG. 1 in a final operating position.
Figure 3:
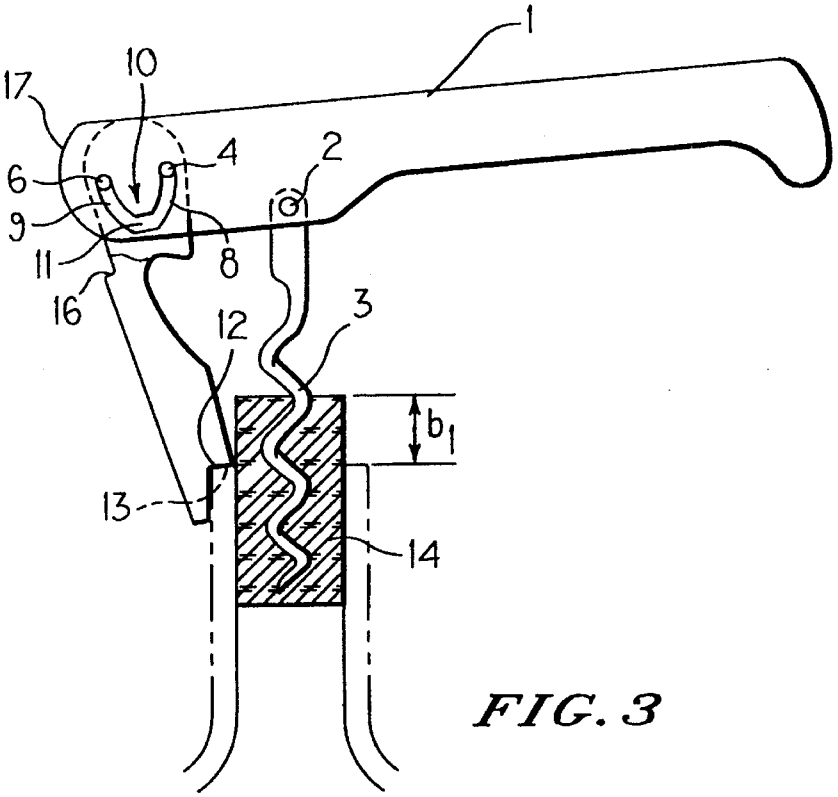
FIG. 3 is a front view of the corkscrew of FIG. 1 in an intermediate operating position.
Figure 7:
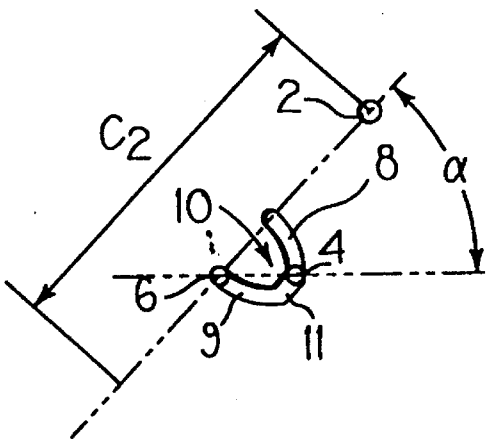
FIGS. 5, 6, and 7 are functional schematics of the corkscrew of FIG. 1 in the operating positions of FIGS. 2, 3, and 4, respectively.
Figure 5:
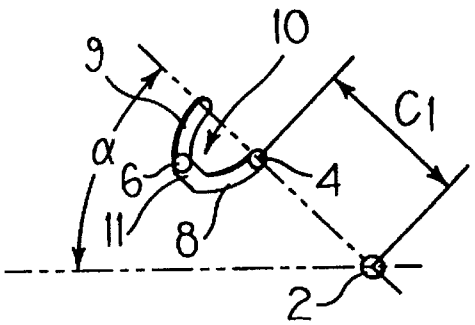

FIG. 5 schematically shows what happens when an extraction operation of the cork 14 is starting. The arm between the pin 2 and the pin 4 makes an angle e with respect to a horizontal line. The handle 1 initially turns around the pin 4, and cork extraction consequently starts. The first phase of the extraction process (FIG. 3) corresponds to rotation of the handle 1, starting from the position of FIG. 2 up to the position of FIG. 3. A further rotation of the handle 1, which is substantially equal to the angle α, is made, no longer around the pin 4, but now around the pin 6. Thanks to this rotation, the cork extraction run is equal to b2 (FIGS. 4 and 7). It is apparent that, thanks to a further small rotation of the handle 1 around the pin 6, the cork 14 is definitively extracted from the bottle neck.

Figure 8:
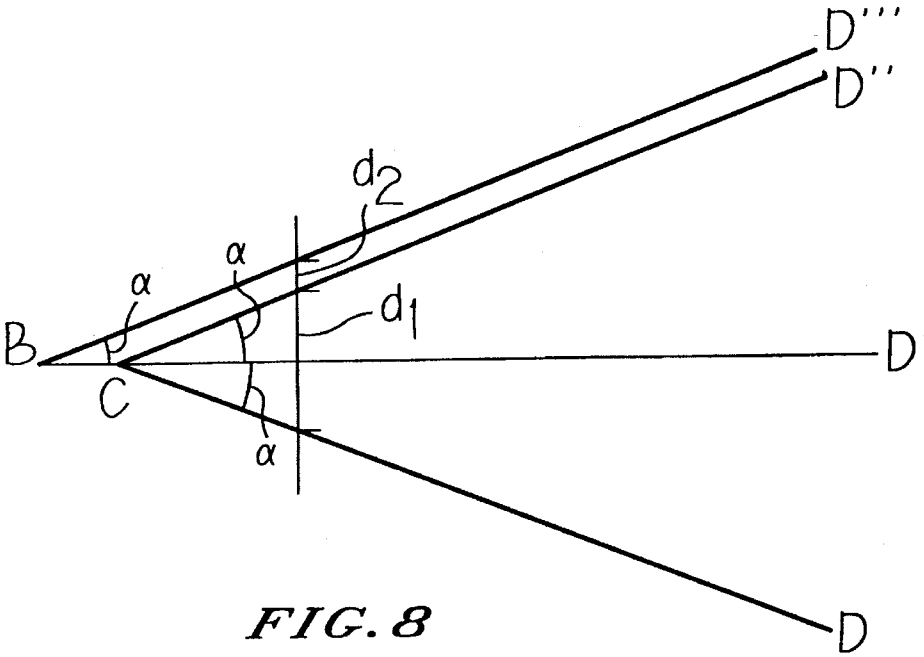

FIGS. 5, 6, 7, 8, and 9 explain how it is possible to effect a complete extraction of the cork 14, avoiding further, lost-time operation of screwing extractions means, and so on as it was described before. In detail, FIG. 8 points out how a traditional pocket corkscrew works. Such a pocket corkscrew does not permit an increase in the length of the arm 2–4. Practical cork extraction runs can correspond to d1. In contrast, with the corkscrew according to the invention, the arm 2–4, together with the handle 1, initially makes a rotation which is equal to α, passing from the line C–D to the line C–D'. At this moment, the arm 2–4 increases to become the arm 2–6 (FIG. 6), as the pin 4 is replaced by the pin 6. FIG. 8 shows this passage with the line B–C. A further rotation, which is substantially equal to α, causes an increase of the cork extraction run which is practically equal to $$.5\ d1+d2$$

This further increase in d2 causes a definitive extraction of the cork from the bottle neck.

Figure 9:
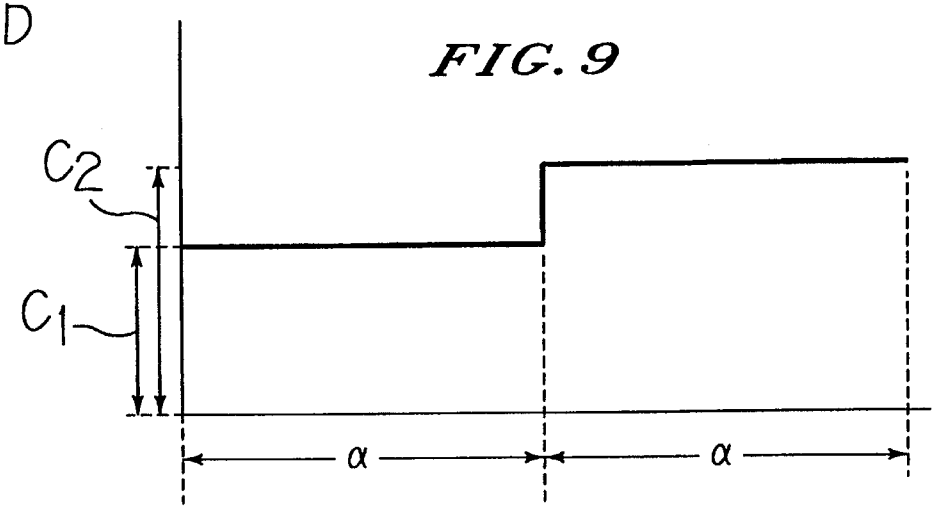
FIGS. 8 and 9 are two functional schematics of corkscrew operation.

FIG. 7 schematically explains what happens, whereas the diagram in FIG. 9 shows how, after a first rotation equal to α of the handle 1, the arm c1 is replaced by the arm c2, causing, in such a way, an increase of the cork extraction run. It is apparent that that increase is instantaneous and, therefore, not gradual, during rotation of the arm 1. During the first rotation of the arm 1, which is substantially equal to the angle α, the pin 6 slides along the leg 9 of the U-shaped slot 10, according to a circular path with a center on the pin 4. During the second rotation of the arm 1, which is also substantially equal to the angle α, and which starts from the position represented in FIG. 6, the pin 4 rotates along the leg 8 of the U-shaped slot 10, according to a circular path with a center on the pin 6 (FIG. 7).

It is, therefore, apparent that the pocket corkscrew according to the invention completely satisfies the requirements of a substantial handiness and a production cost substantially lower than similar devices. Moreover, no operation is required for reloading the corkscrew after extracting a cork before the corkscrew can be again used.

I claim:

1. A pocket corkscrew comprising:

(a) a handle acting as a second class lever;

(b) an extraction element and a propping element, said extraction element being rotated around a first pin on said handle, said propping element being rotated around a second pin on said handle; and (c) automatic and instantaneous variation means of an arm between said first and second pin, as a second class lever handle, in order to allow said extraction element to extract a cork from a bottle neck in just one operation avoiding a reloading operation of the pocket corkscrew before a new extraction operation, wherein:

(d) said second pin is made of a couple of pins, a left one and a right one;

(e) said right pin is the fulcrum of said handle during the first extraction run of a cork;

(f) said left pin is the fulcrum of said handle during the second and definitive extraction run of a cork; and (g) passage of the fulcrum from the right pin to the left pin is instantaneous and automatic.

2. A pocket corkscrew as recited in claim 1 wherein:

(a) said right and said left pins slide in a slot;

(b) said slot comprises two paths, the first one being run by said right pin and the second one being run by said left pin; and (c) a common intermediate path connects said first and second paths into just one slot.

3. A pocket corkscrew as recited in claim 2 wherein:

(a) first rotation of said handle is at least substantially equal to the angle $\alpha$ during said first rotation of the arm between its fulcrum and its resistance point is equal to c1;

(b) second rotation of said handle is at least substantially equal to the angle $\alpha$ during said second rotation of the arm between its fulcrum and its resistance point is substantially equal to c2, c1 being less than c2, causing in such a way an increase of the cork extraction run, said cork extraction run being equal to d2.

4. A pocket corkscrew as recited in claim 2 wherein:

(a) the outline of said first and second paths are circular sectors;

(b) the center of said first path is given by said left pin; and (c) the center of said second path is given by said right pin.

* * * * *

UNITED STATES PATENT AND TRADEMARK OFFICE

CERTIFICATE OF CORRECTION

PATENT NO. : 5,454,282

DATED : October 03, 1994

INVENTOR(S) : Licinio Del Mistro

It is certified that error appears in the above-indentified patent and that said Letters Patent is hereby corrected as shown below:

Column 3, line 5, change "an (cl)" to --an arm (cl)--;
line 43, change "second class levers" to --second class lever fulcra--

Column 4, line 16, change "angle e" to --angle a--.
line 25, change "(Figs. 4 and 7)" to --(Fig. 4)--;
line 59, change "the pin 4 rotates" to --the pin 4 slides--.

Signed and Sealed this

Thirtieth Day of July, 1996

Bruce Lehman

*Attest:*

BRUCE LEHMAN

*Attesting Officer*

*Commissioner of Patents and Trademarks*